US006984179B2

(12) United States Patent
Braly et al.

(10) Patent No.: US 6,984,179 B2
(45) Date of Patent: Jan. 10, 2006

(54) GOLF CLUB SHAFTS HAVING VARIABLE TAPER LENGTHS

(75) Inventors: W. Kim Braly, Scottsdale, AZ (US); Joseph M. Braly, Kennett Square, PA (US)

(73) Assignee: Royal Precision, Inc., Torrington, CT (US)

( * ) Notice: Subject to any disclaimer, the term of this patent is extended or adjusted under 35 U.S.C. 154(b) by 0 days.

(21) Appl. No.: 10/282,077

(22) Filed: Oct. 28, 2002

(65) Prior Publication Data

US 2004/0082403 A1 Apr. 29, 2004

(51) Int. Cl.
*A63B 53/12* (2006.01)

(52) U.S. Cl. ..... 473/289; 473/323; 473/316

(58) Field of Classification Search ..... 473/289, 473/323, 316

See application file for complete search history.

(56) References Cited

U.S. PATENT DOCUMENTS

| | | | | | |
|---|---|---|---|---|---|
| 1,740,144 | A | | 12/1929 | Barrett | |
| 1,884,589 | A | | 10/1932 | Davies | |
| 2,344,779 | A | | 3/1944 | Kolderman et al. | |
| 3,564,886 | A | | 2/1971 | Nakamura | |
| 3,871,649 | A | * | 3/1975 | Kilshaw | 473/289 |
| 3,969,155 | A | * | 7/1976 | McKeighen | 148/671 |
| 4,169,595 | A | | 10/1979 | Kaugars | |
| 4,431,187 | A | | 2/1984 | Rumble et al. | |
| 4,555,112 | A | * | 11/1985 | Masghati | 473/289 |
| 5,022,652 | A | | 6/1991 | Fenton | |
| RE33,735 | E | * | 11/1991 | Rumble et al. | 473/323 |
| 5,192,073 | A | * | 3/1993 | Iwanaga et al. | 473/289 |
| 5,203,190 | A | | 4/1993 | Kramer et al. | |
| 5,481,892 | A | | 1/1996 | Roper et al. | |
| 5,524,466 | A | | 6/1996 | Coe | |
| 5,620,380 | A | | 4/1997 | Tennent et al. | |
| 5,857,921 | A | | 1/1999 | Braly et al. | |
| D407,456 | S | | 3/1999 | De La Cruz et al. | |
| 5,924,936 | A | * | 7/1999 | Penley | 473/289 |
| 6,014,879 | A | | 1/2000 | Jaekel et al. | |
| 6,044,678 | A | | 4/2000 | Olszewski | |
| 6,071,460 | A | | 6/2000 | Renaudin et al. | |
| 6,216,509 | B1 | | 4/2001 | Lotspaih et al. | |
| 6,319,147 | B1 | * | 11/2001 | Nakamura et al. | 473/287 |
| 2001/0014626 | A1 | | 8/2001 | Takiguchi et al. | |

* cited by examiner

*Primary Examiner*—Stephen Blau
(74) *Attorney, Agent, or Firm*—Hudak, Shunk & Farine Co. LPA

(57) ABSTRACT

A golf club set which comprises a plurality of golf clubs having shafts of different tapered section lengths, at least two golf club shafts of the set having differing taper lengths and preferably differing taper angles, the tapered section length of the shaft increases as the shaft length increases for each club throughout the set, and vice versa. Accordingly, each shaft throughout the set of shafts has a distinct taper length. The distinct variable taper clubs provide efficient energy transfer, better feel perception by the golfer, greater ball flight distance, less ball flight dispersion, and greater club stability.

36 Claims, 3 Drawing Sheets

GOLF CLUB SHAFTS HAVING VARIABLE TAPER LENGTHS

FIELD OF THE INVENTION

The present invention relates to at least two golf club shafts having differing taper lengths and preferably differing taper angles. In particular, the invention relates to a golf club set which comprises a plurality of golf clubs having shafts of different tapered section lengths. More specifically, as disclosed herein, the tapered section length of the shaft increases as the shaft length increases for each club throughout the set, and vice versa. Accordingly, each shaft throughout the set of shafts has a distinct taper length. The distinct variable taper clubs provide efficient energy transfer, better feel perception by the golfer, lower ball launch angles, greater ball flight distance and speed, less ball flight dispersion due to lower spin rates, and greater club stability.

BACKGROUND OF THE INVENTION

Typical golf club sets include three types of clubs called "woods," "irons," and "putters" which are well known in the art. Woods, also referred to as "drivers" and "fairway woods", are generally used to hit the ball as far as possible. Irons are used to hit the ball a given or specific distance dictated by the position of the ball on the course. These types of clubs, including wedges, are also referred to as "controlled distance clubs". Putters are used to hit the ball short distances on a green into the hole.

While the flight distance of a ball hit by a golf club depends on a golfer's skills, the a) ball direction, b) flight distance and c) trajectory ultimately depend on the efficiency of the golf club itself.

The shaft design, length, and the club head loft help determine the playing characteristics of the club. As the shaft length increases, speed of the club head increases and on impact with the ball, the ball travels farther. As the shaft length decreases, the speed of the impact of the club head on the ball decreases, causing the ball to travel a shorter distance. In addition, as the loft increases, the potential arc or trajectory of the ball in flight also increases. As the ball trajectory increases, the potential ball distance decreases. Conversely, as the loft decreases, the potential arc or trajectory of the ball in flight also decreases. As the ball trajectory decreases, the more the potential ball distance increases.

Typical golf club sets consist of clubs having different lofts, lies and lengths. Throughout the set, as the shaft length increases, the loft and lie angles decrease. Nominally, the golf club shaft lengths increase or decrease by predetermined increments between adjacent clubs of the set. For a set of irons, the shaft stiffness generally increases from the long irons to the short irons, i.e., the short irons will have more shaft stiffness than the long irons due to the length of the club and weight of the head.

Golf club shafts are designed to have a butt section and a tip section interconnected by a tapered section, wherein the butt section has a larger outer diameter than the tip section. The butt and tip sections typically have a constant outer diameter throughout their length. The outer diameter is reduced from the butt to the tip by utilizing a tapered section.

The prior art shafts have tapered sections which are substantially the same length throughout the entire set of golf clubs. By having a relatively shorter tip section relative to the butt section, an increase in the overall shaft stiffness is obtained. Thus, a set of iron shafts, using prior art design techniques, uses different relative tip and butt lengths while maintaining an equal tapered section length to generate a progressive stiffness throughout the set.

In view of the present invention, the disadvantages of a constant tapered section length throughout the set of clubs are having reduced energy transfer, poor feel perceived by the golfer, less ball flight distance, greater ball flight dispersion, and less golf club stability.

SUMMARY OF THE INVENTION

The present invention relates to at least two golf club shafts having differing taper lengths and preferably differing taper angles. In particular, the invention relates to a golf club set which comprises a plurality of golf clubs having shafts of different tapered section lengths. More specifically, as disclosed herein, the tapered section length of the shaft increases as the shaft length increases for each club throughout the set, and vice versa. Accordingly, each shaft throughout the set of shafts has a distinct taper length.

The tapered section of each shaft in a set increases or decreases in length by a predetermined increment when compared to the next higher numbered, successive, or shorter shaft; or lower numbered or longer shaft, respectively, of the set of shafts. Advantageously, club sets having shafts of varying taper section lengths provide more efficient energy transfer, better feel as perceived by the golfer, greater ball flight distance, less ball flight dispersion, and greater club stability.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

As is known in the art, an individual golf club comprises a shaft and a club head. A grip is preferably applied over at least the butt section of the shaft. A set of golf clubs generally includes a plurality of irons, various wedges, and at least one driver or wood. A set of golf irons generally comprises clubs including a one iron, generally a two or three iron, through a nine iron, with the one iron being longer than the nine iron and the irons therebetween decreasing proportionately in length as the iron number increases. A wedge is generally shorter in length than a nine iron and a wood or driver typically has a greater length than a one iron. Throughout a set of iron golf clubs, as the shaft length increases, the loft angle of the club head typically decreases. Accordingly, short irons are more lofted and shorter in length than the long irons.

The present invention provides a set of golf clubs comprising golf club shafts having tapered sections which increase in length for each club throughout the set as shaft length increases. At least two golf club shafts are provided having tapered sections of different lengths. Stated in another manner, the tapered section of the golf club shaft increases in length as the shaft length increases. Moreover, the taper per inch rate of the tapered section increases as shaft length decreases.

The present invention provides a set of golf club shafts comprising at least two shafts which have tapered sections of different lengths. The shafts of the present invention provide more efficient energy transfer when compared to the prior art clubs having tapered sections of a single length. The shafts of the present invention also provide better feel as perceived by a golfer, greater ball flight distance, and less ball flight dispersion. As utilized throughout the specification, a set of shafts refers to at least two shafts, and preferably two or more shafts, and most preferably at least a set of irons, including clubs from a three iron to a nine iron as known in the art.

Figure 1:
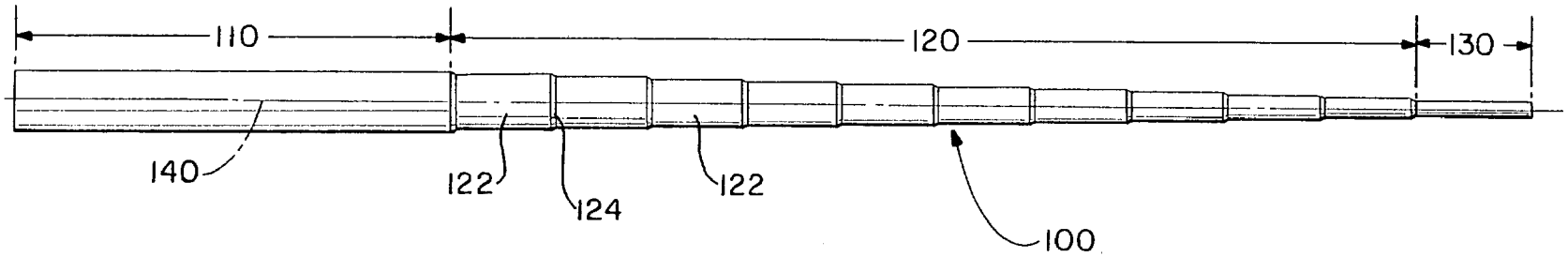
FIG. 1 is a side elevational view of a golf club shaft according to the present invention including a tapered section having a plurality of constant diameter steps of varying outer diameters and tapered transition areas, wherein the tapered section interconnects a tip section and a butt section.

Making reference now to the drawings, wherein like numerals indicate like or corresponding parts throughout the several figures, a golf club shaft prepared according to the present invention is shown in FIG. 1, and is generally designed 100. The shaft 100 includes a butt or grip section 110, a tip section 130, and a step down tapered section 120 therebetween. As is clear from the drawings, the butt, tip, and interconnecting tapered sections have a common, central longitudinal axis 140 extending therethrough. Similarly, FIG. 2 illustrates shaft 200, which includes a butt section 210, a tip section 230, and an interconnecting tapered section 220 having a substantially constant taper rate.

Figure 2:
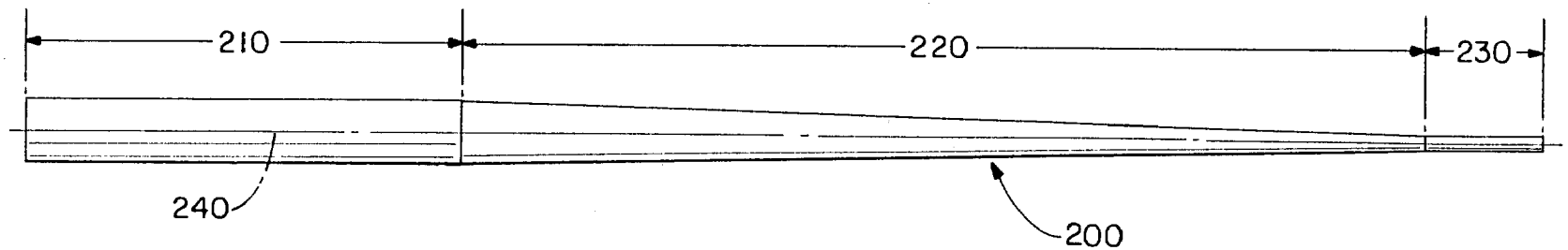
FIG. 2 is a side elevational view of a golf club shaft having a tapered section which tapers at a substantially constant rate.

As shown in FIGS. 1 and 2, the butt section 110, 210 have a constant outer diameter along their lengths. The outer diameter of the butt section ranges generally from about 0.550 to about 0.625 inch, and desirably from about 0.560 to about 0.610 inch, and preferably from about 0.600 to about 0.610 inch. Alternatively, the butt section can be tapered and thus have a reduction in outer diameter of less than about 0.010 inch per linear inch of the butt section along the longitudinal axis of the shaft. The length of the butt section along the longitudinal axis generally ranges from about 4 to about 16 inches, and preferably from about 8 to about 12 inches.

Preferably, each shaft in the set of shafts has a butt section 110, 210 which is substantially equal, or equal in length when compared to the butt section of one or all other shaft(s) in the set. Alternatively, a first shaft can have a butt section length which is generally within about 3 inches, desirably from within 2 inches, and preferably within 1 inch when compared to the length of the butt section of a second shaft in the set.

Tip sections 130, 230 as shown in FIGS. 1 and 2, are illustrated having a constant outer diameter. The outer diameter of the tip section of a shaft of the present invention ranges generally from about 0.294 to about 0.500 inch, desirably from about 0.300 to about 0.450 inch, and preferably from about 0.335 to about 0.370 inch. However, the tip section can be tapered as known in the art. If tapered, the outer diameter of the tip section would decrease from a location where it connects to the tapered section 120 to the distal end thereof. The outer diameter of the tip section can be reduced in a range generally from about 0.001 to about 0.020 inches per linear inch of the tip section, desirably from about 0.005 to about 0.010 inches per linear inch of the tip section, and preferably is about 0.0075 inches per linear inch of the tip section. The length of the tip section of a shaft is generally from about 2 to about 12 inches, desirably from about 2 to about 8 inches, and preferably from about 0 to about 5 inches.

Preferably, each shaft in the set of shafts has a tip section 130 which is substantially equal, or equal in length measured along the longitudinal axis when compared to the tip section of one or all other shaft(s) in the set. Alternatively, a shaft tip section length which is generally within about 3 inches, desirably from about 2 inches, and preferably substantially equal to the length of the tip section of a second shaft in the set.

Each golf club shaft of the present invention includes a tapered section which interconnects the tip section and butt section of the shaft. The tapered section reduces the diameter of the shaft from the relatively larger butt section to the relatively smaller tip section. The tapered section can have numerous configurations, such as, but not limited to, a step-down tapered section, a constant or substantially constant diameter taper rate reduction, or a combination thereof. FIG. 1 illustrates a golf club shaft having a step-down tapered section 120. FIG. 2 illustrates a golf club shaft with a tapered section 120 having a substantially constant reduction in diameter from the butt section to the tip section.

The tapered portion 120 of shaft 100 of FIG. 1 includes a plurality of steps 122 interconnected by tapered transition areas 124. In a preferred embodiment, each step portion 122 is cylindrical in shape, and has a substantially constant outer diameter along its longitudinal axis length. The outer diameter of each step portion is greater than the previous step portion when measured from the tip section 130 to the butt section 110. Accordingly, the outer diameter of the shaft is increased from the tip section 130 to the butt section 110 in the tapered section 120. The length of each step portion can individually vary and range generally from about 0.25 inch to about 4.0 inch, desirably from about 0.75 inch to about 3.0 inch, more desirably from about 0.90 inch to about 2.0 inch, and preferably about 1 inch in length. There are generally from about 10 to about 20 step portions 122 in the tapered section 120 of shaft 100, with about 15 to about 18 step portions being preferred.

As shown in FIG. 1, a plurality of transition areas 124 are present in the tapered section 120 and interconnect each step portion 122, as well as the tip portion 130 and the butt portion 110 to the tapered section. The transition areas 124 provide for diametrical reduction from one step portion to another in a direction from the butt section to the tip section. The transitional areas can have a length when measured parallel to the longitudinal axis of the shaft 140 which can be relatively short and thus provide a relatively sharp, noticeable reduction in diameter. Alternatively, the transitional areas can have a length which is relatively long so that the reduction in diameter in step portions is less visible and not as steep or sharp. The length of each transition area can vary and range generally from about 0.134 to about 0.381 inch, desirably from about 0.140 to about 0.286 inch, and preferably from about 0.190 to about 0.226 inch. The shape of the transition areas 124 are generally frustoconical. Typically, longer transition areas are preferred as they result in improved characteristics for the shaft including greater durability.

FIG. 2 is a side elevational view of a golf club shaft 200. Shaft 200 includes a butt section 210, a tip section 230 or an interconnecting tapered section 220. Central longitudinal axis 240 extends through the shaft 200. The butt section and tip section of shaft 200 can have lengths and outer diameters as described hereinabove in relation to shaft 100. As shown in FIG. 2, shaft 200 includes tapered section 220 having a substantially constant reduction in diameter from the butt section 210 to tip section 230.

Figure 3A:
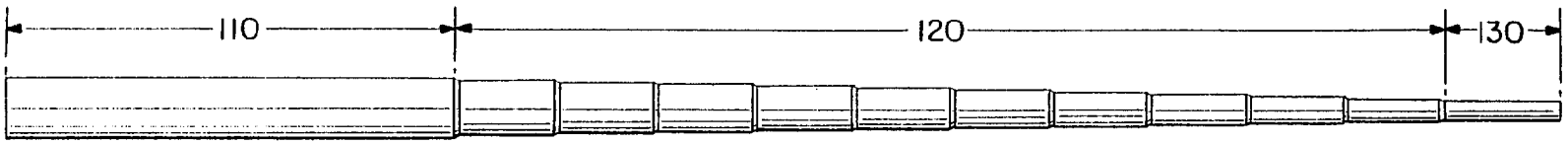
FIGS. 3A–3C are side elevational views of a plurality of golf club shafts of the present invention, each shaft having step-down tapered sections of different lengths.
Figure 3B:
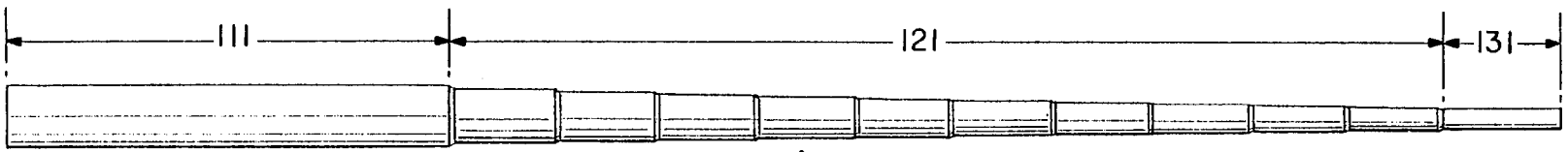
Figure 3C:
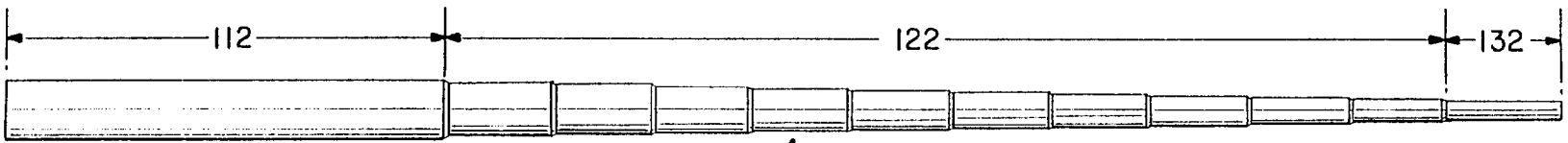

FIGS. 3A–3C illustrate a set of golf club shafts formed according to the present invention. The set includes first shaft 100 (FIG. 3A), second shaft 101 (FIG. 3B) and third shaft 102 (FIG. 3C). Each shaft, respectively, includes a butt section 110, 111 and 112, a tip section 130, 131 and 132 and a tapered section 120, 121 and 122. Every shaft in a set of shafts has at least one adjacent or next shaft having a tapered section which is either comparatively longer or shorter in length. For example, considering a five iron, the next higher and lower numbered clubs as known in the art are the six iron and four iron, respectively. In the present invention, the four iron has a taper length greater than that of the five iron and the six iron has a taper length shorter than the five iron and also shorter than the four iron. Along these lines, a nine iron has an eight iron as an adjacent or next numbered club, with the nine iron having a shorter taper length than the eight iron, etc.

When considering the taper lengths of shafts of the present invention, the taper length between two adjacent numbered clubs has a difference, generally, of about from about 0.1 or 0.02 to about 2 inches, desirably from about 0.25 to about 1 inch, more desirably from about 0.30 to about 0.75 inches, and preferably about 0.5 inches. Moreover, in a set of clubs, a golf club shaft which is "z" units in a series away from a first club would have a taper length="z" multiplied by the incremental difference in taper length between the first shaft and a next numbered shaft, i.e., adjacent shaft. For example, FIG. 3A illustrates first shaft 100 which can be a five iron having a section tapered length of 25 inches. Second shaft 101 can be a four iron having tapered length section 121 with a length of 25.5 inches. Accordingly, the taper length difference between shaft 100 and 101 is 0.5 inch. Third shaft 102 can be considered a three iron and tapered section 122 has a length of 26 inches, which is 0.5 inches greater than second shaft 101 and 1 inch (2× 0.5) greater than shaft 100. Preferably, the taper length difference between successive shafts in a set of shafts is the same. Accordingly, from the above example, a set of shafts of varying taper lengths can be formed with adjacent clubs varying by the same incremental unit, such as 0.5 inches. Alternatively, it may be desirable to increase or decrease the taper length by a predetermined factor throughout an increase or decrease in shaft length.

As stated hereinabove, it is preferred that within a set of shafts prepared according to the present invention the butt sections and tip section dimensions of each shaft are substantially equal. The following Table 1 illustrates a preferred embodiment of the present invention, wherein the overall shaft length increases by a factor of 0.5 inch between adjacent clubs and that the taper length varies by a difference of 0.5 inch between adjacent shafts.

TABLE 1

| Club No. (Iron) | Overall Shaft Length (inch) | Tapered Section Length (inch) | Tip Section Length (inch) | Butt Section Length (inch) |
|---|---|---|---|---|
| 1 Iron | 41½ | 27 | 3.0 | 11.5 |
| 2 | 41 | 26½ | 3.0 | 11.5 |

TABLE 1-continued

| Club No. (Iron) | Overall Shaft Length (inch) | Tapered Section Length (inch) | Tip Section Length (inch) | Butt Section Length (inch) |
|---|---|---|---|---|
| 3 | 40½ | 26 | 3.0 | 11.5 |
| 4 | 40 | 25½ | 3.0 | 11.5 |
| 5 | 39½ | 25 | 3.0 | 11.5 |
| 6 | 39 | 24½ | 3.0 | 11.5 |
| 7 | 38½ | 24 | 3.0 | 11.5 |
| 8 | 38 | 23½ | 3.0 | 11.5 |
| 9 | 37½ | 23 | 3.0 | 11.5 |
| Wedge | 37 | 22½ | 3.0 | 11.5 |

Figure 4A:
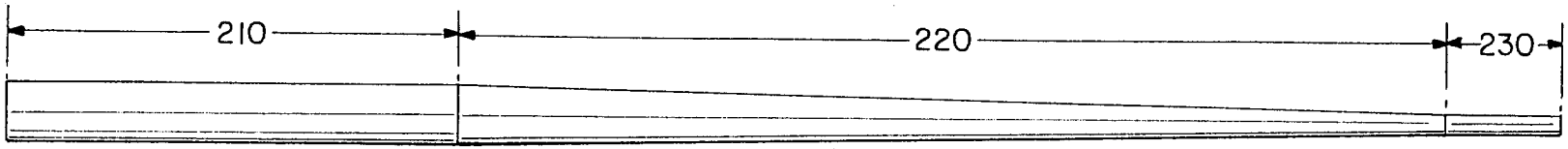
FIGS. 4A–4C are side elevational views of a plurality of golf club shafts of the present invention, each shaft being a different length and having tapered sections of different lengths and substantially constant taper rates.
Figure 4B:
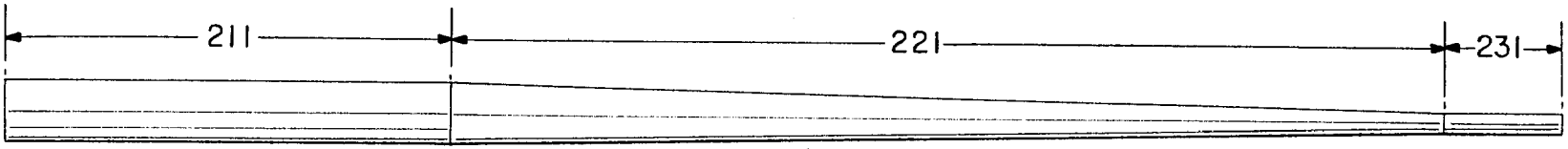
Figure 4C:
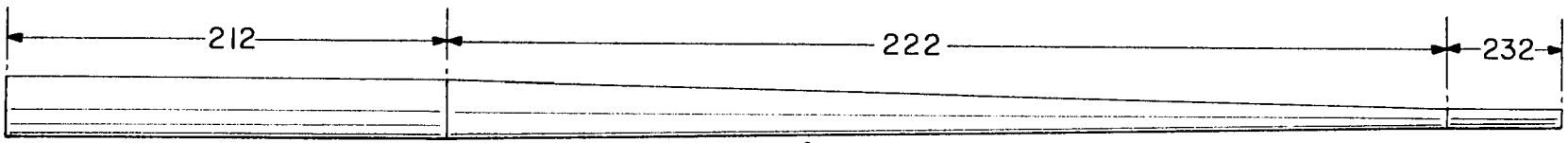

FIGS. 4A–4C illustrate a set of shafts 200 (FIG. 4A), 201 (FIG. 4B) and 202 (FIG. 4C), each including a butt section 210, 211 and 212, a tip section, 230, 231 and 232, and tapered sections 220, 221 and 222, respectively. The tapered sections of the shafts have a substantially constant taper rate change and the length differences between each successive club are the same as noted hereinabove in regard to the shafts of FIG. 3 with the tapered section 220 being shorter than the taper length of tapered section 221, and also shorter than the tapered section of tapered section 222.

In a further embodiment of the present invention, a set of shafts is produced wherein at least two shafts have different or non-identical taper rates in the tapered section of the shaft. In a preferred embodiment, a shorter shaft has a greater taper rate than a longer shaft. Thus, a shorter shaft has a sharper decrease or increase in outer diameter than a relatively longer shaft in the tapered section thereof.

The taper rate between a first shaft and an adjacent or next higher numbered or lower numbered shaft of a set has a difference generally of from about 0.00005 to about 0.0010 inches, desirably from about 0.00008 to about 0.00075 inches and preferably from about 0.0001 to about 0.0002 inches per linear inch of tapered section length.

The following Table 2 sets forth a preferred embodiment for a change in taper rate for a set of golf club shafts numbered one iron through a wedge.

TABLE 2

| Club No. (Iron) | Overall Shaft Length (inch) | Taper per Linear Inch (inch) |
|---|---|---|
| 1 | 41½ | .0085 |
| 2 | 41 | .0087 |
| 3 | 40½ | .0089 |
| 4 | 40 | .0090 |
| 5 | 39½ | .0092 |
| 6 | 39 | .0094 |
| 7 | 38½ | .0096 |
| 8 | 38 | .0098 |
| 9 | 37½ | .0100 |
| Wedge | 37 | .0102 |

As can be seen from the above chart, the five iron has a taper rate of 0.0092 inches per linear inch of tapered section and the adjacent six iron has a taper rate of 0.0094 inches per linear inch of tapered section, thus providing a taper rate difference of 0.0002 inches per linear inch of tapered section between adjacent clubs.

The golf club shafts of the present invention are formed from metal, or a metal matrix composite, preferably tubes of metal or metal matrix composite. As utilized throughout the specification, a tube generally refers to a hollow cylinder or pipe having a constant outer diameter. The inner diameter, and thus the transverse cross-sectional thickness throughout the length of the tube, can be constant or can vary in one or more areas. That is, the inner diameter and thus, the wall thickness, can be varied throughout the length of the tube, and can even contain repeating patterns or "cycles" such as, but not limited to, sinusoidal cycles. A tube is generally considered a shaft after a process modifies, by increasing or decreasing, at least a portion of the outer diameter so that the same is no longer constant. The shaft is still a "tube" after being formed, albeit a specialized tubular blank having a special use. The shafts of the present invention are preferably manufactured from conventional metal such as steel, titanium, aluminum, or alloys thereof. The shaft can also be a metal matrix composite as known in the art, wherein a matrix metal, such as, but not limited to, aluminum surrounds or envelopes fibers such as silicon carbide whiskers.

The blank shafts of the present invention can be formed utilizing tube mandrel drawing or swaging techniques which are known in the art. During the process of forming the blank shaft, the tubular stock is generally drawn over a plug mandrel, or series of plug mandrels.

While manufactured tubes can be utilized, it is often desirable to begin the shaft formation process utilizing a planar piece or strip of metal. While thickness of the planar piece is not critical, the metal piece preferably has a constant thickness with suitable ranges being generally from about 0.030 to about 0.090 inch, and preferably from about 0.045 to about 0.055 inch thick. The planar piece is roll formed and welded by induction or resistance methods, well known to those of ordinary skill in the art, into a tube. Alternatively, the shaft formation process can be started by utilizing a seamless tube which has been formed by an extrusion process as known to those of ordinary skill in the art. The length of the tube at this point of the operation is not critical.

The tube is optionally annealed to soften or further prepare the material for subsequent forming. As known to those of ordinary skill in the art, the temperatures, times and types of atmospheres, i.e., air or inert environment, can vary depending on the metal or metal matrix composite utilized.

The tube is drawn in at least one and preferably at least four mandrel operations utilizing drawing practices known to those of ordinary skill in the art. The final drawing process forms the blank length and various other dimensions of the shaft such as the variable wall sections, butt diameter, etc. If desired, the tube can also be annealed before, between, or after any of the drawing process steps. If desired, variable wall thicknesses can be introduced into the tube during any of the drawing steps. This can be accomplished by moving a tapered inner mandrel in relation to an outer forming die when the tube material is drawn therebetween. As known in the art, the tapered section can be formed having a substantially constant taper rate increase or decrease, or can have stepped portions and transition areas therein. As is stated hereinabove, the present invention tubes or shafts can be formed with any number or combinations of variable wall thicknesses. Wall thickness is generally predicated upon imparting the necessary strength and stiffness to the golf club shafts, and excess wall thickness is avoided because it adversely contributes to the weight thereof.

As is known in the art, stepped shafts are generally formed by holding the butt end of the shaft rigidly, and pushing the opposite end of the tube, which will become the tip section of the shaft, axially through one or more cylindrical dies, the inside diameter of which are less than the butt end diameter. The tube is pushed sufficiently far through each die such that the shaft obtains the appropriate diameter of each point along its length.

After the shaft has been formed into the desired dimensions, additional processing steps to impart characteristics such as strength and cosmetic appearance to the shaft can be performed, and include but are not limited to, cutting the tip and butt sections to predetermined lengths, heat treating, polishing, plating, etc.

It is to be understood that the method for forming a first shaft and a second shaft, as well as any additional shafts in the golf club shaft set will vary in the manner the tapered section is formed utilizing cold forming techniques such as compression, expansion and swaging. That is, the first shaft will be formed in one manner to produce a certain taper length and a second shaft will be formed in another manner to produce the second taper length which is different than that of the first shaft. In this manner, a set of shafts of the present invention are created.

As the shafts of the present invention have differing taper lengths and optionally differing taper rates, each individual shaft of the set is formed by slightly differing processes to increase or decrease the taper length of each shaft. That is, the forming process for a first shaft is different than for a second shaft to create differences in taper length. The possible variable taper rates of each club will also modify the production forming process for each club in the set.

A set of steel shafts prepared according to the present invention was formed utilizing swaging to produce shafts for different clubs as indicated in Table 3 below. It is to be understood that other processes, which are conventionally known to those of ordinary skill in the art, can be utilized to form the shafts of the present invention.

Table 3 sets forth the shaft parameters, i.e., the overall length, tapered section length, butt section length, tip section length and taper rate for a set of clubs prepared according to the present invention. As can be seen, the tapered length decreases by 0.5 inch for each 0.5 inch decreases in overall shaft length. Additionally, the taper rate increases as the club length decreases.

TABLE 3

| Club Number (Iron) | Overall Length (inch) | Taper Length (inch) | Taper Rate (inch/ linear inch) | Tip Length (inch) | Butt Length (inch) |
|---|---|---|---|---|---|
| 1 | 41.5 | 27 | 0.0085 | 3 | 11.5 |
| 2 | 41 | 26.5 | 0.0087 | 3 | 11.5 |
| 3 | 40.5 | 26 | 0.0089 | 3 | 11.5 |
| 4 | 40 | 25.5 | 0.0090 | 3 | 11.5 |
| 5 | 39.5 | 25 | 0.0092 | 3 | 11.5 |
| 6 | 39 | 24.5 | 0.0094 | 3 | 11.5 |
| 7 | 38.5 | 24 | 0.0096 | 3 | 11.5 |
| 8 | 38 | 23.5 | 0.0098 | 3 | 11.5 |
| 9 | 37.5 | 23 | 0.0100 | 3 | 11.5 |
| Wedge | 37 | 22.5 | 0.0102 | 3 | 11.5 |

EXAMPLES

The invention will be better understood by reference to the following examples which serve to illustrate but not to limit the present invention.

A comparative test between a golf club from a set of golf clubs having variable taper length shafts formed by the method of the present invention, and a prior art golf club was performed.

The test utilized a present invention golf club shaft having an overall length of 36.25 inches, a tapered section length of 24.5 inches and a taper rate decreasing from the butt section to the tip section at 0.0094 inch per linear inch, a butt section of 8.75 inches and a tip section of 3.0 inches. The shaft was fitted with a six iron club head with a weight of 261 grams, a loft of 26.5 degrees and a lie angle of 62 degrees, and D2 swing weight at 299 c.p.m.

The prior art shaft tested was a six iron having a TrueTemper Dynamic Gold stepped shaft, from a set of clubs having equal length tapered sections. The prior art club shaft had an overall length of 36.25 inches including a taper length of 23 inches, a butt section length of 5.75 inches and a tip section length of 7.5 inches. An identical club head as described hereinabove was utilized. Both the prior art and present invention club had an overall finished length of 37.5 inches.

A random, unbiased test was performed utilizing ten different golfers. Each golfer was instructed to hit ten shots with each club utilizing the same type of ball and swing each time. The golfers were above average in skill. The swing results were recorded by Swing Dynamics Ball Flight Monitor. Table 4 set forth below lists the results of the swing test conducted and includes distance (yards), launch angle (degree), ball spin (rpm), ball speed (mph), club head speed (mph), power transfer index (PTI), club utilized and the specific ball type utilized by each golfer. The power transfer index (PTI) is a measure of golf club efficiency, wherein the greater the number, the greater the power transfer.

TABLE 4

| Golfer | Shaft | Club Type | Ball Type | Dist (Yds) | Launch Angle (Deg) | Spin Rate (RPM) | Ball Speed (MPH) | Club Head Speed (MPH) | PTI |
|---|---|---|---|---|---|---|---|---|---|
| 1 | Present Invention | Six iron | Titleist Pro | 196 | 13.4 | 5707 | 134 | 91 | 1.48 |
| 1 | Prior Art | Six iron | Titleist Pro | 194 | 17.3 | 5240 | 130 | 90 | 1.45 |
| 2 | Present invention | Six iron | Callaway H | 194 | 14.1 | 5856 | 131 | 91 | 1.44 |
| 2 | Prior Art | Six iron | Callaway H | 192 | 15.9 | 5906 | 130 | 92 | 1.42 |
| 3 | Present Invention | Six iron | Titleist Pro | 185 | 18.7 | 5042 | 124 | 85 | 1.45 |
| 3 | Prior Art | Six iron | Titleist Pro | 184 | 19.1 | 5402 | 124 | 86 | 1.44 |
| 4 | Present Invention | Six iron | Nike DD | 189 | 15.3 | 5171 | 127 | 87 | 1.46 |
| 4 | Prior Art | Six iron | Nike DD | 183 | 15.0 | 5642 | 123 | 87 | 1.42 |
| 5 | Present Invention | Six iron | Callaway H | 194 | 14.1 | 5856 | 131 | 91 | 1.44 |
| 5 | Prior Art | Six iron | Callaway H | 192 | 15.9 | 5906 | 130 | 92 | 1.42 |
| 6 | Present Invention | Six iron | Titleist Pro | 195 | 17.5 | 5539 | 132 | 90 | 1.46 |
| 6 | Prior Art | Six iron | Titleist Pro | 194 | 19.1 | 5510 | 131 | 89 | 1.47 |
| 7 | Present Invention | Six iron | Titleist Pro | 184 | 14.9 | 4640 | 123 | 82 | 1.51 |
| 7 | Prior Art | Six iron | Titleist Pro | 179 | 17.2 | 4223 | 120 | 82 | 1.45 |
| 8 | Present Invention | Six iron | Nike DD | 214 | 14.5 | 3909 | 143 | 89 | 1.62 |
| 8 | Prior Art | Six iron | Nike DD | 211 | 16.1 | 4214 | 141 | 90 | 1.57 |
| 9 | Present Invention | Six iron | Titleist Pro | 200 | 16.7 | 5969 | 137 | 92 | 1.48 |
| 9 | Prior Art | Six iron | Titleist Pro | 195 | 19.2 | 5951 | 134 | 94 | 1.42 |
| 10 | Present Invention | Six iron | Callaway H | 185 | 15.3 | 4196 | 124 | 83 | 1.50 |
| 10 | Prior Art | Six iron | Callaway H | 178 | 14.3 | 5132 | 120 | 84 | 1.44 |

TABLE 5

Summary of Test Results

| Average | Shaft | Dist (Yds) | Launch Angle (Deg) | Spin Rate (RPM) | Ball Speed (MPH) | Club Head Speed (MPH) | PTI |
|---|---|---|---|---|---|---|---|
| Golfers 1–10 | Present Invention | 193.6 | 15.45 | 5188.5 | 130.6 | 88.1 | 1.48 |
| Golfers 1–10 | Prior Art | 190.2 | 16.90 | 5332.6 | 128.3 | 88.6 | 1.45 |
| Difference | | +3.4 | −1.45 | −144.1 | +2.3 | −0.5 | +0.03 |

As can be seen from the club head speed averages for the present invention shaft and the prior art shaft, the test was a true comparative, unbiased test as the club head speeds only had a difference of 0.5 mph between the clubs tested. The relatively small difference in the club head speed shows that both clubs were swung in essentially the same way. The benefits of the present invention shafts and clubs produced therewith are apparent from side-by-side average comparisons listed in Table 5. The present invention shaft on average hit a ball a further distance by 3.4 yards and had a lower launch angle of 1.45 degrees less than the comparative prior art club. Advantageously, the ball spin was considerably less for the present invention shaft, which on the average was 144.1 rpm lower than the comparative shaft. Furthermore, the present invention club with the variable taper length shaft imparted a higher ball speed on average of 2.3 mph and a greater power transfer index of 0.03. Accordingly, the golf clubs and sets formed from the variable taper length shafts of the present invention provide more efficient energy transfer, lower ball launch angles, greater ball flight distance and speed when compared to a prior art golf club.

In accordance with the patent statutes, the best mode and preferred embodiment have been set forth, the scope of the invention is not limited thereto, but rather by the scope of the attached claims.

What is claimed is:

1. A set of golf club shafts, comprising:

at least a first shaft and a second shaft, each said shaft having only a tip section, a butt section, and a tapered section which interconnects said tip and butt sections, said first shaft tapered section having a length which is longer or shorter than a length of said second shaft tapered section by a predetermined increment, said shafts being metal or a metal-matrix composite, wherein the shafts of the set have shaft tapered sections which all have a) a step-down tapered section having a plurality of steps along the entire length of said tapered section or b) a taper section having a substantially constant taper rate along the entire length of said tapered section, and wherein said first shaft having a step-down tapered section includes two or more individual steps which have a different length compared to the corresponding steps of said second shaft, wherein the butt sections of all shafts of the set are substantially equal in length with said length being about 8 to about 12 inches, and wherein said first shaft with said substantially constant rate tapered section has a taper rate which is greater or less than a taper rate of said second shaft tapered section wherein said butt section of each shaft has a substantially constant outer diameter along the entire length and wherein said set of golf club shafts is for a set of irons clubs with each shaft being for a different club number.

2. A set of shafts according to claim 1, wherein said first shaft tip section and said second shaft tip section are substantially equal in length with said length being from about 2 to about 8 inches, and wherein said step-down tapered section shafts have about 15 to about 18 step portions.

3. A set of shafts according to claim 1, wherein said predetermined increment is from about 0.10 to about 2.0 inches.

4. A set of shafts according to claim 3, wherein said first shaft tip section has a length which is within about 3 inches of a length of said second shaft tip.

5. A set of shafts according to claim 4, wherein said first shaft tip section length is about 2 to about 8 inches.

6. A set of shafts according to claim 5, wherein said predetermined increment is from about 0.25 to about 1 inch.

7. A set of shafts according to claim 6, wherein said first shaft butt section and second shaft butt section have a substantially constant outer diameter of about 0.550 to about 0.625 inch, and wherein said first shaft tip section and second shaft tip section have a substantially constant outer diameter of about 0.294 to about 0.500 inch.

8. A set of shafts according to claim 6, wherein with respect to said set of b) shafts said first shaft tapered section taper rate and said second shaft tapered section taper rate have a difference of about 0.00005 to about 0.0010 inch, wherein said predetermined increment is from about 0.30 to about 0.75 inch, and wherein said first shaft tip section length is about 2 to about 5 inches.

9. A set of shafts according to claim 8, wherein said first shaft tapered section is longer than said second shaft tapered section, wherein said set further comprises a third shaft through at least a sixth shaft each having a tip section, butt section, and tapered section of said type a) or b) each with respective lengths, wherein said first shaft tapered section length is longest and said sixth shaft tapered section length is shortest of said first through said sixth shafts, and wherein said predetermined incremental length difference is the same between each adjacent shaft, and wherein with respect to said a) shafts, a selected shaft has at least two step sections which have a different length when compared to the corresponding step actions of the other shafts of the set.

10. A set of shafts according to claim 9, wherein said length of said tip sections of said shafts are substantially equal.

11. A method for producing a set of golf club shafts, comprising the steps of:

forming a first golf club shaft having only a tip section, a butt section and a tapered section interconnecting said tip and butt sections; and forming a second golf club shaft having only a tip section, a butt section and a tapered section interconnecting said tip and butt sections, said first shaft tapered section having a length which is longer or shorter than a length of said second shaft tapered section by a predetermined increment, said shafts being metal or a metal-matrix composite, wherein the shafts of the set have shaft tapered sections which all have a) a step-down tapered section having a plurality of steps along the entire length of said tapered section or b) a taper section having a substantially constant taper rate, wherein said first shaft having a step-down tapered section includes two or more individual steps which have a different length compared to the corresponding steps of said second shaft, wherein the butt sections of all shafts of the set are substantially equal in length with said length being about 8 to about 12 inches, and wherein said first shaft with said substantially constant rate along the entire length of said tapered section tapered section has a taper rate which is greater or less than a taper rate of said second shaft tapered section wherein said butt section of each shaft has a substantially constant outer diameter along the entire length and wherein said set of golf club shafts is for a set of irons clubs with each shaft being for a different club number.

12. A method according to claim 11, wherein said first shaft tip section and said second shaft tip section are substantially equal in length with said length being from about 2 to about 8 inches, and wherein said step-down tapered section shafts have about 15 to about 18 step portions.

13. A method according to claim 12, wherein said predetermined increment is from about 0.10 to about 2.0 inches.

14. A method according to claim 13, wherein said first shaft tip section has a length which is within about 3 inches of a length of said second shaft tip section.

15. A method according to claim 14, wherein said first shaft tip section length is about 2 to about 8 inches.

16. A method according to claim 15, wherein said predetermined increment is from about 0.25 to about 1 inch.

17. A method according to claim 16, wherein said first shaft butt section and second shaft butt section have a substantially constant outer diameter of about 0.550 to about 0.625 inch.

18. A method according to claim 16, wherein with respect to said set of b) shafts said first tapered shaft section taper rate and said second shaft tapered section taper rate have a difference of about 0.00005 to about 0.0010 inch, wherein said predetermined increment is from about 0.30 to about 0.75 inch, and wherein said first shaft tip section length is about 2 to about 5 inches.

19. A method according to claim 18, wherein said first shaft tapered section is longer than said second shaft tapered section, wherein said set further comprises a third shaft through at least a sixth shaft each having a tip section, butt section, and tapered section of said type a) or b) each with respective lengths, wherein said first shaft tapered section length is longest and said sixth shaft tapered section length is shortest of said first through said sixth shafts, and wherein said predetermined incremental length difference is the same between each adjacent shaft, and wherein with respect to said a) shafts, a selected shaft has at least two step sections which have a different length when compared to the corresponding step actions of the other shafts of the set.

20. A method according to claim 19, wherein said length of said tip sections of said shafts are substantially equal.

21. A set of golf club shafts, comprising:

a plurality of metal or metal-matrix composite shafts, each shaft having only a butt portion, a tip portion, and a tapered portion between said butt and tip portions, the length of the tapered portion of each shaft of the set being different than any other shaft tapered portion length, wherein the set shafts tapered portions have either a) a plurality of individual steps along the entire length of said tapered portion with the provision that at least two steps of a selected shaft have a different length compared to the corresponding step sections of each other shaft of the set or b) a smooth taper having a substantially constant taper rate along the entire length of said tapered portion, wherein the butt sections of all shafts of the set are substantially equal in length with said length being about 8 to about 12 inches, and wherein said first shaft with said substantially constant rate tapered section has a taper rate which is greater or less than a taper rate of said second shaft tapered section wherein said butt portion of each shaft has a substantially constant outer diameter along the entire length and wherein said set of golf club shafts is for a set of irons clubs with each shaft being for a different club number.

22. A set of shafts according to claim 21, wherein each shaft tip portion is substantially equal in length with said length being from about 2 to about 8 inches, and where said step tapered section shafts have about 15 to about 18 step portions.

23. A set of shafts according to claim 21, wherein said shafts have said a) step section tapered portion, and wherein the outer diameter of each succeeding step is greater than the previous step portion when measured in a direction from the tip portion to the butt portion.

24. A set of shafts according to claim 23, wherein each step has a length of from about 0.25 inch to about 4.0 inches, and wherein about 10 to about 20 steps are present on each shaft, or a combination thereof.

25. A set of shafts according to claim 24, wherein each step has a length of from about 0.75 inch to about 3.0 inches, and wherein about 15 to about 18 steps are present on each shaft, or a combination thereof.

26. A set of shafts according to claim 25, wherein each step has a length of from about 0.9 inch to about 2.0 inches.

27. A set of shafts according to claim 25, wherein a plurality of transition areas are present in the tapered section and interconnect the butt portion to a step, the tip portion to a step, and each step, and wherein each transition area has a length of from about 0.140 to about 0.286 inch.

28. A set of shafts according to claim 25, wherein the tapered portion length difference between adjacent shafts of the set is from about 0.30 to about 0.75 inch.

29. A set of shafts according to claim 23, wherein a plurality of transition areas are present in the tapered section and interconnect the butt portion to a step, the tip portion to a step, and each step, and wherein each transition area has a length of from about 0.134 to about 0.381 inch.

30. A set of shafts according to claim 29, wherein the tapered portion length difference between adjacent shafts of the set is from about 0.25 to about 2 inches.

31. A set of shafts according to claim 30, wherein said length of said tip sections of said shafts are substantially equal.

32. A set of shafts according to claim 23, wherein the tapered portion length difference between adjacent shafts of the set is from about 0.25 to about 2 inches.

33. A set of shafts according to claim 21, wherein said shafts have said b) a taper with a substantially constant rate, wherein one shaft and an adjacent shaft have a taper rate difference of from about 0.00005 to about 0.001 inch per linear inch of tapered section length.

34. A set of shafts according to claim 33, wherein said taper rate difference is from about 0.00008 to about 0.00075 inch per linear inch of tapered section length.

35. A set of shafts according to claim 34, wherein said taper rate difference is from about 0.0001 to about 0.0002 inch per linear inch of tapered section length.

36. A set of shafts according to claim 33, wherein said length of said tip sections of said shafts are substantially equal.

* * * * *

UNITED STATES PATENT AND TRADEMARK OFFICE

CERTIFICATE OF CORRECTION

PATENT NO. : 6,984,179 B2
APPLICATION NO. : 10/282077
DATED : January 10, 2006
INVENTOR(S) : W. Kim Braly It is certified that error appears in the above-identified patent and that said Letters Patent is hereby corrected as shown below:

Column 12,
Line 42, after "rate", add -- along the entire length of said tapered section --.
Lines 49 and 50, delete "along the entire length of said tapered section".

Signed and Sealed this

Twenty-seventh Day of June, 2006

JON W. DUDAS
*Director of the United States Patent and Trademark Office*